US007972119B2

(12) United States Patent
Ozeki et al.

(10) Patent No.: US 7,972,119 B2
(45) Date of Patent: Jul. 5, 2011

(54) VARIABLE DISPLACEMENT COMPRESSOR

(75) Inventors: Taro Ozeki, Kariya (JP); Yoshinori Inoue, Kariya (JP); Suehiro Fukazawa, Kariya (JP); Masaya Sakamoto, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 281 days.

(21) Appl. No.: 12/264,608

(22) Filed: Nov. 4, 2008

(65) Prior Publication Data

US 2009/0116971 A1 May 7, 2009

(30) Foreign Application Priority Data

Nov. 5, 2007 (JP) ..... 2007-286846

(51) Int. Cl.
*F04B 1/12* (2006.01)

(52) U.S. Cl. ..... 417/269; 417/222.1; 417/222.2; 92/12.2

(58) Field of Classification Search ..... 417/222.2, 417/269, 270, 298, 307, 309, 441; 137/471, 137/472, 489, 493.9, 513.3; 92/12.2, 79, 92/154

See application file for complete search history.

(56) References Cited

U.S. PATENT DOCUMENTS 5,580,224 A * 12/1996 Ikeda et al. ..... 417/269
5,823,294 A * 10/1998 Mizutani et al. ..... 184/6.3
6,568,913 B1 * 5/2003 Strikis et al. ..... 417/199.1
7,150,603 B2 * 12/2006 Lee et al. ..... 417/312
7,204,098 B2 * 4/2007 Yamada et al. ..... 62/470
7,207,185 B2 * 4/2007 Ota et al. ..... 62/193
2004/0148947 A1 * 8/2004 Ota et al. ..... 62/84
2006/0165535 A1 * 7/2006 Ota et al. ..... 417/222.2
2007/0177988 A1 * 8/2007 Inoue et al. ..... 417/269

FOREIGN PATENT DOCUMENTS

JP 59-179284 11/1984
JP 10-311277 11/1998

* cited by examiner

*Primary Examiner* — Devon C Kramer
*Assistant Examiner* — Leonard J Weinstein
(74) *Attorney, Agent, or Firm* — Locke Lord Bissell & Liddell LLP

(57) ABSTRACT

A variable displacement compressor includes a housing, a rotary shaft, a swash plate, a suction pressure region, a suction throttle valve, an oil reservoir, a lubricating oil passage, a gas flow passage, a communication passage, and a throttle mechanism. The suction-pressure region includes a suction chamber and a suction passage. The suction throttle valve is arranged in the suction passage and defines an upstream suction-pressure region and a downstream suction-pressure region. The lubricating oil passage connects the oil reservoir to the upstream suction-pressure region. The gas flow passage connects the crank chamber to the suction chamber. The communication passage connects the lubricating oil passage to at least one of the downstream suction-pressure region, the gas flow passage and the crank chamber. The throttle mechanism is provided in the lubricating oil passage between the oil reservoir and a position where the communication passage connects to the lubricating oil passage.

7 Claims, 9 Drawing Sheets

VARIABLE DISPLACEMENT COMPRESSOR

BACKGROUND OF THE INVENTION

The present invention relates generally to a variable displacement compressor, and more particularly to a variable displacement compressor having a suction throttle valve in a suction passage which is in communication with a suction chamber.

A conventional variable displacement refrigerant compressor is disclosed in Japanese Patent Application Publication No. 10-311277 (such type of compressor being referred to merely as "compressor"). In the compressor, lubricating oil in refrigerant gas in the form of a mist is separated therefrom before refrigerant gas under a high pressure is discharged out of the compressor into an external refrigerant circuit. The oil is then collected and stored in an oil reservoir to be supplied to a crank chamber.

In the compressor, lubricating oil is constantly supplied from the oil reservoir into the crank chamber during the operation of the compressor in the entire range from the maximum displacement to the minimum displacement. Thus, lubricating oil may be supplied to various sliding parts of the compressor during the operation at a high speed under a low load in which the flow rate of circulating refrigerant gas is decreased.

For lubrication of the sliding parts, lubricating oil separated from refrigerant gas may be supplied to the crank chamber through the suction chamber.

According to the compressor disclosed in Japanese Patent Application Publication No. 10-311277, however, an excessive amount of lubricating oil is supplied constantly to the crank chamber when the compressor is operated at the minimum displacement thereof. If lubricating oil is stored excessively in the crank chamber, the lubricating oil is agitated at a high speed by rotating parts of the compressor such as a swash plate, so that frictional heat is generated.

The frictional heat thus generated by the agitation causes the temperature of the compressor to rise, which may deteriorate the durability of the sliding parts and various types of seal members made of rubber or resin in the compressor.

To solve the above problem, a suction throttle valve may be provided in the suction passage in communication with the suction chamber. This causes lubricating oil stored in the oil reservoir to be supplied to a region of the suction passage which is located upstream of the suction throttle valve. When the compressor is operating at the minimum displacement or stopped, the suction throttle valve is closed. Thus, lubricating oil supplied from the oil reservoir is stored in the region of the suction passage upstream of the suction throttle valve, so that lubricating oil is hardly supplied to the crank chamber. In the above structure, the operation of the compressor is changed from the maximum displacement to the minimum displacement or to a stopped state, and then the compressor operation is changed to the maximum displacement again in a short time. In this time, refrigerant gas in the crank chamber whose pressure is increased during changing the operation to the minimum displacement flows toward the suction chamber through a gas flow passage. Since the suction throttle valve is then closed, the refrigerant gas has no way to flow. Thus, the crank pressure cannot be reduced rapidly. Therefore, it may take a long time until the crank pressure is reduced to a predetermined desired pressure when the operation of the compressor is changed to the maximum displacement.

The present invention, which has been made in view of the above problems, is directed to a compressor which prevents lubricating oil from being supplied to the crank chamber excessively, and is operated to return to the maximum displacement smoothly.

SUMMARY OF THE INVENTION

In accordance with an aspect of the present invention, a variable displacement compressor includes a housing, a rotary shaft, a swash plate, a suction pressure region, a suction throttle valve, an oil reservoir, a lubricating oil passage, a gas flow passage, a communication passage, and a throttle mechanism. The housing defines a crank chamber. The rotary shaft is rotatably supported by the housing. The swash plate is accommodated in the crank chamber, tiltably supported by the rotary shaft and rotates integrally with the rotary shaft. The suction-pressure region includes a suction chamber and a suction passage through which refrigerant gas under a pressure lower than a discharge pressure passes to the suction chamber. The suction throttle valve has a valve body for adjusting opening of the suction passage. The suction throttle valve is arranged in the suction passage. The suction throttle valve defines an upstream suction-pressure region located upstream of the suction throttle valve and a downstream suction-pressure region located downstream of the suction throttle valve in the suction pressure region. The oil reservoir stores lubricating oil separated from refrigerant gas. The lubricating oil passage connects the oil reservoir to the upstream suction-pressure region. The gas flow passage connects the crank chamber to the suction chamber. The communication passage connects the lubricating oil passage to at least one of the downstream suction-pressure region, the gas flow passage and the crank chamber. The throttle mechanism is provided in the lubricating oil passage between the oil reservoir and a position where the communication passage connects to the lubricating oil passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe a variable displacement compressor (hereinafter referred to merely as "compressor") according to the first preferred embodiment with reference to the FIGS. 1 through 4. For the sake of explanatory convenience, the left side as viewed in FIG. 1 corresponds to the front side of the compressor, and the right side corresponds to the rear side of the compressor.

Figure 1:
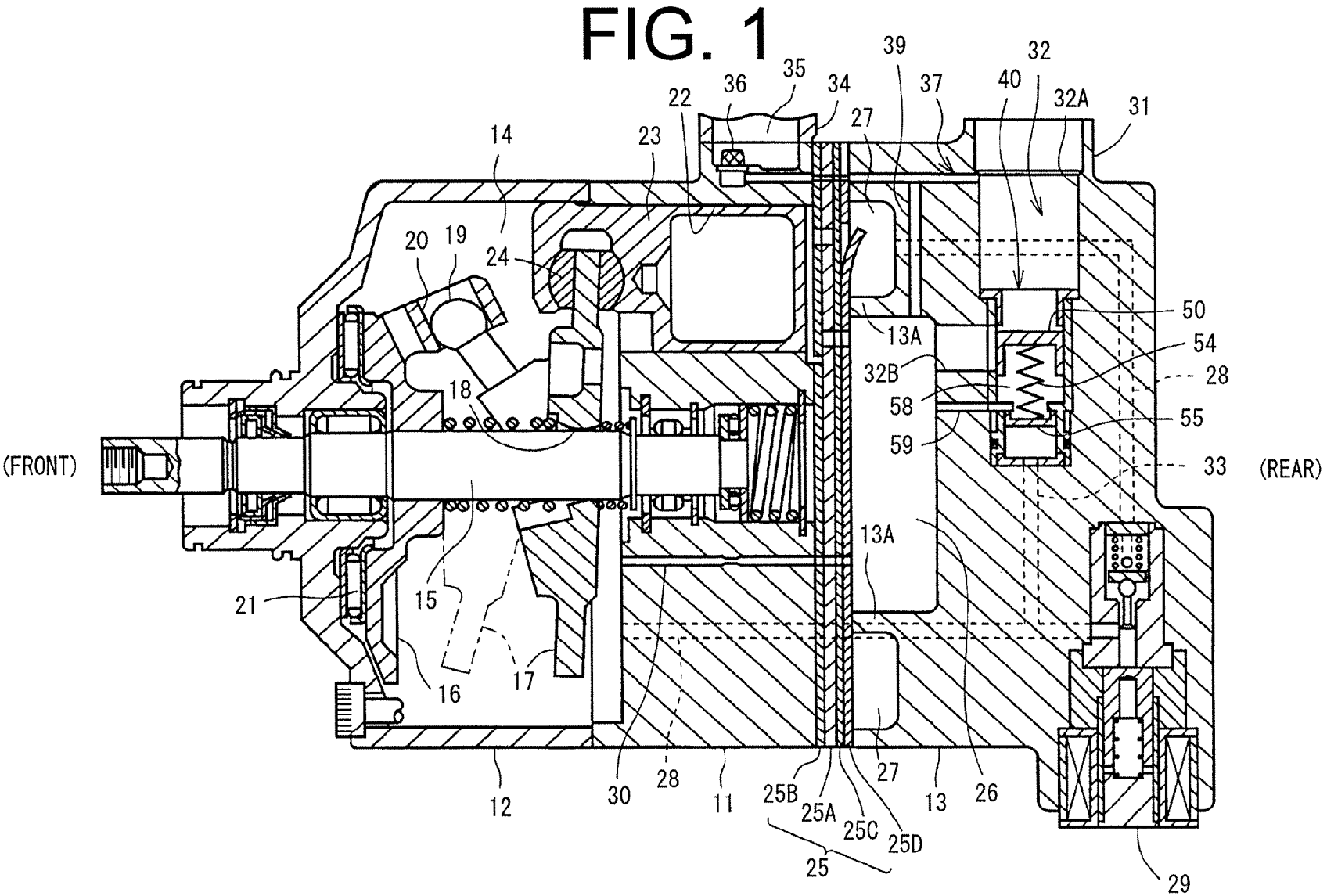
FIG. 1 is a longitudinal cross-sectional view of a clutchless type variable displacement compressor according to a first preferred embodiment of the present invention.

Referring to the FIG. 1, the compressor has a cylinder block 11, a front housing 12, and a rear housing 13. The front housing 12 is joined to the front end of the cylinder block 11, and the rear housing 13 is joined to the rear end of the cylinder block 11. The cylinder block 11 and the front housing 12 cooperate to define therebetween a crank chamber 14 through which a rotary shaft 15 extends.

The rotary shaft 15 is rotatably supported by the cylinder block 11 and the front housing 12. The front end of the rotary shaft 15 extends out of the front housing 12, and is connected to a mechanism (not shown) which receives power transmitted from a drive source (not shown) such as a engine or a motor of a vehicle.

In this clutchless type compressor, the power of the vehicle engine is constantly transmitted to the rotary shaft 15. In the crank chamber 14, a lug plate 16 is fixedly mounted on the rotary shaft 15, and a swash plate 17 engaged with the lug plate 16 is mounted on the rotary shaft 15.

The swash plate 17 has a hole 18 formed at the center thereof through which the rotary shaft 15 extends. The swash plate 17 has guide pins 19 which are slidably inserted in guide holes 20 formed in the lug plate 16, so that the swash plate 17 is connected to the lug plate 16 for rotation integrally with the rotary shaft 15. The swash plate 17 is provided for sliding in the axial direction of the rotary shaft 15 and tiltably supported by the rotary shaft 15. A thrust bearing 21 is provided between the lug plate 16 and the front inner wall of the front housing 12, thus the lug plate 16 being slidable relative to the front housing 12 through the thrust bearing 21.

The cylinder block 11 has a plurality of cylinder bores 22 formed therethrough and arranged around the rotary shaft 15. Each of the cylinder bores 22 accommodates therein a piston 23 for reciprocation. The piston 23 is engaged at the front end thereof with the outer peripheral portion of the swash plate 17 through a pair of shoes 24. As the swash plate 17 is driven to rotate with the rotary shaft 15, each piston 23 reciprocates in the cylinder bore 22 through the shoes 24.

A flange 34 is joined to the top peripheral surface of the cylinder block 11. The flange 34 and the cylinder block 11 cooperate to define an oil reservoir 35 storing therein lubricating oil. Lubricating oil contained in refrigerant gas under a discharge pressure in the form of mist is separated by an oil separator (not shown) from the refrigerant gas, and then stored in the oil reservoir 35. The oil separator is disposed in a refrigerant gas passage (not shown) serving as a part of the discharge-pressure region of the compressor and connecting a discharge chamber 27, which will be described later, to an external refrigerant circuit (not shown). The oil reservoir 35 also forming a part of the discharge-pressure region of the compressor is disposed above a suction throttle valve 40 which will be described later.

Figure 2:
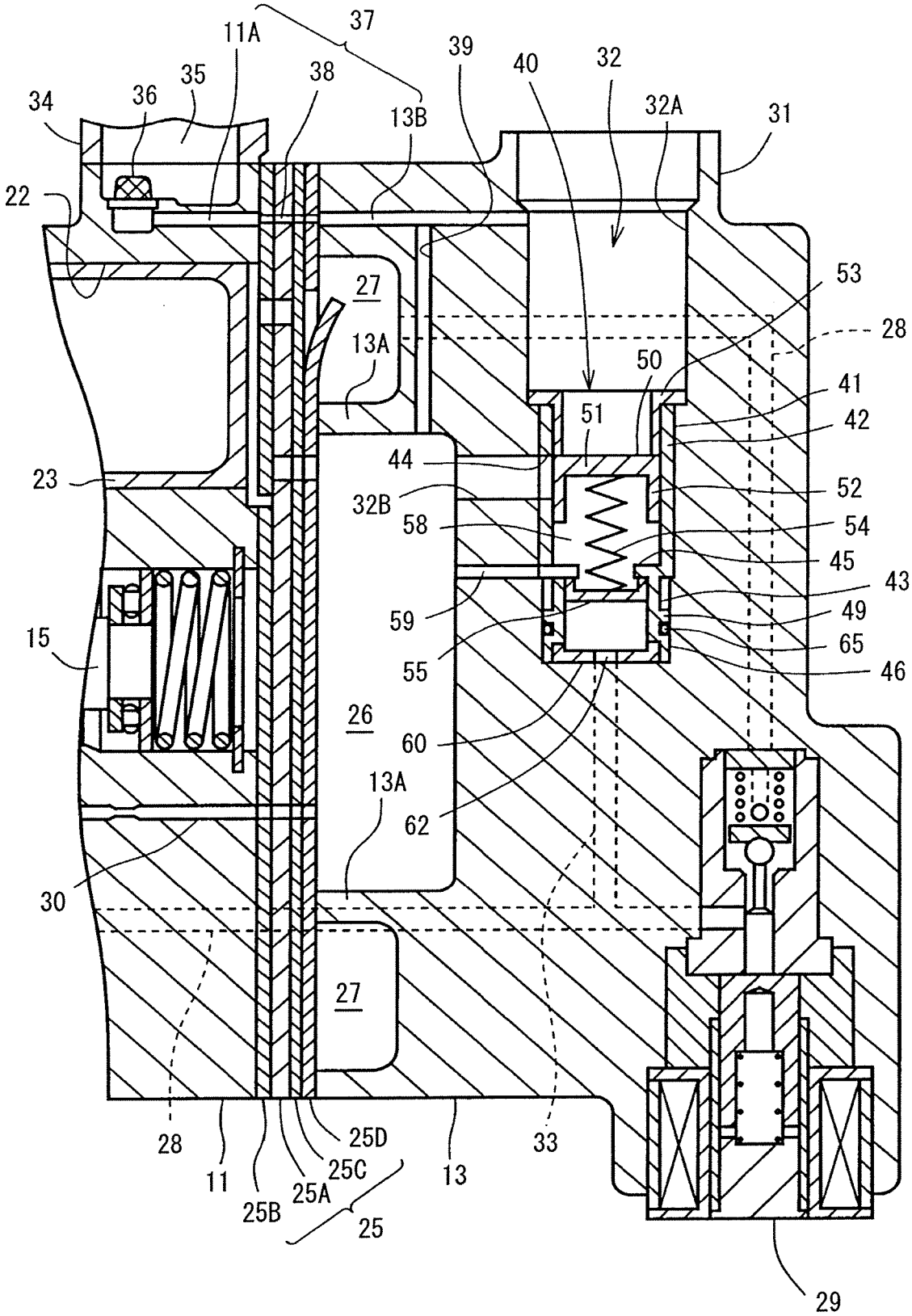
FIG. 2 is a fragmentary enlarged longitudinal cross-sectional view of the variable displacement compressor of FIG. 1.

A suction chamber 26 is formed in the rear housing 13 at a radially inner region thereof in facing relation to a valve forming assembly 25, and the discharge chamber 27 is defined in the rear housing 13 at a radially outer region thereof so as to surround the suction chamber 26. As shown in FIGS. 1 and 2, the rear housing 13 is formed with a partition 13A for separating the suction chamber 26 from the discharge chamber 27. A communication passage 28 is formed extending in the cylinder block 11 and the rear housing 13 and connecting the crank chamber 14 to the discharge chamber 27. A displacement control valve 29 of an electromagnetic type is disposed in the communication passage 28. The cylinder block 11 has a bleed passage 30 serving as a gas flow passage for constant communication between the crank chamber 14 and the suction chamber 26.

The rear housing 13 has an inlet 31. The inlet 31 is exposed outside and in communication with the suction chamber 26 through a suction passage 32. The inlet 31 is connected to an external refrigerant circuit (not shown). The compressor has a suction-pressure region including the inlet 31, the suction passage 32, and the suction chamber 26. Refrigerant gas is under a pressure lower than a discharge pressure passes through the suction passage 32 to the suction chamber 26. The suction pressure region is connected to the external refrigerant circuit on the low pressure side of the compressor, through which refrigerant gas under a low pressure passes. The suction passage 32 has a suction throttle valve 40 for adjusting the opening degree of the suction passage 32. For the sake of explanatory convenience, the part of the suction passage 32 upstream of the suction throttle valve 40 with respect to the flow of refrigerant gas therein will be referred to as upstream suction passage 32A. Similarly, the part of the suction passage 32 downstream of the suction throttle valve 40 will be referred to as downstream suction passage 32B. The suction-pressure region includes an upstream region as an upstream suction-pressure region located upstream of the suction throttle valve 40, and a downstream region as a downstream suction-pressure region located downstream of the suction throttle valve 40. The upstream region includes the inlet 31 and the upstream suction passage 32A, while the downstream region includes the downstream suction passage 32B and the suction chamber 26.

Referring to FIG. 2, the suction throttle valve 40 has a valve housing 41 which is made of resin and has a cylindrical shape with openings at both ends. The valve housing 41 has an upper housing portion 42 and a lower housing portion 43. A first valve body 50 is accommodated in the upper housing portion 42, and a second valve body 55 is accommodated in the lower housing portion 43, respectively. For the sake of explanatory convenience, in FIGS. 1 through 4, the side of the suction throttle valve 40 corresponding to the upper housing portion 42 will be referred to as the upper side of the suction throttle valve 40. Similarly, the side of the suction throttle valve 40 corresponding to the lower housing portion 43 will be referred to as the lower side of the suction throttle valve 40.

The upper housing portion 42 has an inner diameter larger than that of the lower housing portion 43. The upper housing portion 42 has a circumferential wall through which a communication hole 44 is formed in communication with the downstream suction passage 32B. The valve housing 41 is so formed that the outer peripheral surface thereof corresponds to the surface of the suction passage 32. The communication hole 44 in the upper housing portion 42 faces the suction passage 32 which is positioned adjacent to the suction chamber 26. The first valve body 50 accommodated in the upper housing portion 42 has an outer diameter corresponding to the inner diameter of the upper housing portion 42. Thus, the first valve body 50 is vertically movably arranged in the upper housing portion 42. The first valve body 50 is moved to the lowermost position thereof in the upper housing portion 42 when the flow rate of refrigerant gas is the maximum, and moved to the uppermost position thereof when the flow rate is the minimum. The first valve body 50 has a main valve portion 51 and an annular side wall 52. The side wall 52 closes the entire communication hole 44 when the first valve body 50 is moved to the uppermost position thereof in the upper housing portion 42.

A cylindrical cap 53 whose outer diameter corresponds to the inner diameter of the upper housing portion 42 is inserted in the top open end of the upper housing portion 42. The top open end of the cylindrical cap 53 is flanged, and engaged with the top open end of the upper housing portion 42. The lower end of the cylindrical cap 53 inserted in the upper housing portion 42 determines the uppermost position of the first valve body 50. The valve housing 41 has an annular projection 45. The annular projection 45 extends radially inward from the inner peripheral surface of the valve housing 41 at a position between the upper housing portion 42 and the lower housing portion 43. The annular projection 45 determines the lowermost position of the first valve body 50.

The second valve body 55 is vertically movably arranged in the lower housing portion 43, and has an outer diameter corresponding to the inner diameter of the lower housing portion 43. The annular projection 45 determines also the uppermost position of the second valve body 55. The valve housing 41 has a damper chamber 58. The damper chamber 58 is defined between the second valve body 55 and the first valve body 50. A coil spring 54 is arranged in the damper chamber 58 for urging the first valve body 50 and the second valve body 55 to be separated away from each other. In other word, the first valve body 50 and the second valve body 55 are connected each other by the coil spring 54.

When the crank chamber 14 is in communication with the discharge chamber 27 through the communication passage 28, or when the displacement control valve 29 is opened, the second valve body 55 is moved toward the uppermost position thereof. This causes the first valve body 50 to move toward the uppermost position thereof.

When the second valve body 55 is moved to the uppermost position thereof, the coil spring 54 increases the upward urging force applied to the first valve body 50. The damper chamber 58 is in communication with the suction chamber 26 through a damper communication passage 59 shown in FIGS. 1, 2.

The lower housing portion 43 has a large-diameter end 46 formed at the lower open end thereof. The large-diameter end 46 has a larger diameter than the second valve body 55. The large-diameter end 46 serves as a fitted portion and holds a valve seat 60 therein. The valve seat 60 has a hole 62 at the center thereof. The hole 62 is in communication with a branch passage 33 which is connected with the communication passage 28 in the rear housing 13. The top surface of the valve seat 60 determines the bottom position of the second valve body 55.

The lower housing portion 43 has a rib 49 at a position slightly above the large-diameter end 46. An O-ring 65 is arranged between the rib 49 and the large-diameter end 46. The O-ring 65 serves to prevent refrigerant gas under a crank pressure Pc, or a pressure in the crank chamber 14, from leaking to the suction side. The second valve body 55 is subjected to the crank pressure Pc through the branch passage 33 branched from the communication passage 28. Then, the second valve body 55 is moved vertically in the lower housing portion 43 in response to the crank pressure Pc.

A lubricating oil passage 37 is formed between the upstream suction passage 32A upstream of the suction throttle valve 40 and the oil reservoir 35 in the cylinder block 11. The lubricating oil passage 37 is comprised of a cylinder block passage 11A, a rear housing passage 13B and a throttle passage 38. The cylinder block passage 11A is formed in communication with the bottom of the oil reservoir 35 in the cylinder block 11. The rear housing passage 13B is formed in communication with the suction passage 32 upstream of the suction throttle valve 40 in the rear housing 13. The throttle passage 38 is formed in the valve forming assembly 25, and serves as a throttle mechanism. Lubricating oil in the oil reservoir 35 is supplied through the lubricating oil passage 37 to the suction passage 32 upstream of the suction throttle valve 40. The cylinder block passage 11A has a filter 36 disposed at the inlet of the lubricating oil passage 37 adjacent to the oil reservoir 35. The filter 36 separates foreign substances such as dust from the lubricating oil stored in the oil reservoir 35 before passing through the lubricating oil passage 37. According to the first preferred embodiment, the valve forming assembly 25 has a valve plate 25A, a suction valve forming plate 25B, a discharge valve forming plate 25C and a retainer forming plate 25D.

The throttle passage 38 provided in the valve forming assembly 25 has a diameter or a cross-section which is smaller than those of the cylinder block passage 11A and the rear housing passage 13B or the other part of the lubricating oil passage. Thus, lubricating oil supplied toward the upstream suction passage 32A upstream of the suction throttle valve 40 is throttled. Therefore, the throttle passage 38 serves as a throttle mechanism in the lubricating oil passage 37. In other words, the throttle passage 38 determines the flow rate of lubricating oil flowing through the lubricating oil passage 37. When lubricating oil is not stored sufficiently in the oil reservoir 35, the throttle passage 38 regulates the flow of refrigerant gas under a discharge pressure from the oil reservoir 35 through the lubricating oil passage 37 toward the suction passage 32.

A communication passage 39 is branched from the lubricating oil passage 37 downstream of the throttle passage 38. The communication passage 39 according to the first preferred embodiment connects the lubricating oil passage 37 to the suction chamber 26. The communication passage 39 allows a part of lubricating oil flowing through the lubricating oil passage 37 to flow into the suction chamber 26. The communication passage 39 also allows refrigerant gas in the crank chamber 14 to flow to the external refrigerant circuit through the inlet 31 for facilitating to release the pressure in the crank chamber 14.

The following will describe the operation of the compressor according to the first preferred embodiment of the present invention. In operation of the compressor when the piston 23 reciprocates due to the rotation of the rotary shaft 15, refrigerant gas in the suction chamber 26 is introduced through a suction port of the valve forming assembly 25 into the cylinder bore 22 while opening the suction valve. Subsequently, the refrigerant gas in the cylinder bore 22 is compressed, the compressed refrigerant gas opens a discharge valve, and flows into the discharge chamber 27. Most of the high-pressured refrigerant gas flown into the discharge chamber 27 flows out into the external refrigerant circuit (not shown).

Opening degree of the displacement control valve 29 is adjusted to control the relation of the amount of the refrigerant gas. The relation is between the amounts of the refrigerant gas introduced from the discharge chamber 27 to the crank chamber 14 through the communication passage 28 and flowing from the crank chamber 14 to the suction chamber 26 through the bleed passage 30. This determines the crank pressure Pc in the crank chamber 14. The opening degree of the displacement control valve 29 is adjusted to change the crank pressure Pc in the crank chamber 14. Accordingly, the pressure differential between the crank chamber 14 and the cylinder bores 22 through the pistons 23 is changed thereby to vary the inclination angle of the swash plate 17. Therefore, due to the variation of the inclination angle of the swash plate 17, the stroke of the pistons 23 is changed, thereby adjusting the displacement of the compressor.

When the crank pressure Pc is reduced, the inclination angle of the swash plate 17 with respect to a plane perpendicular to the axial direction of the rotary shaft 15 is increased, so that the stroke of the piston 23 is increased. As a result, the displacement of the compressor is increased. When the crank pressure Pc is increased, on the other hand, the inclination angle of the swash plate 17 is reduced and the stroke of the piston 23 is decreased, accordingly, with the result that the displacement of the compressor is decreased.

Figure 3:
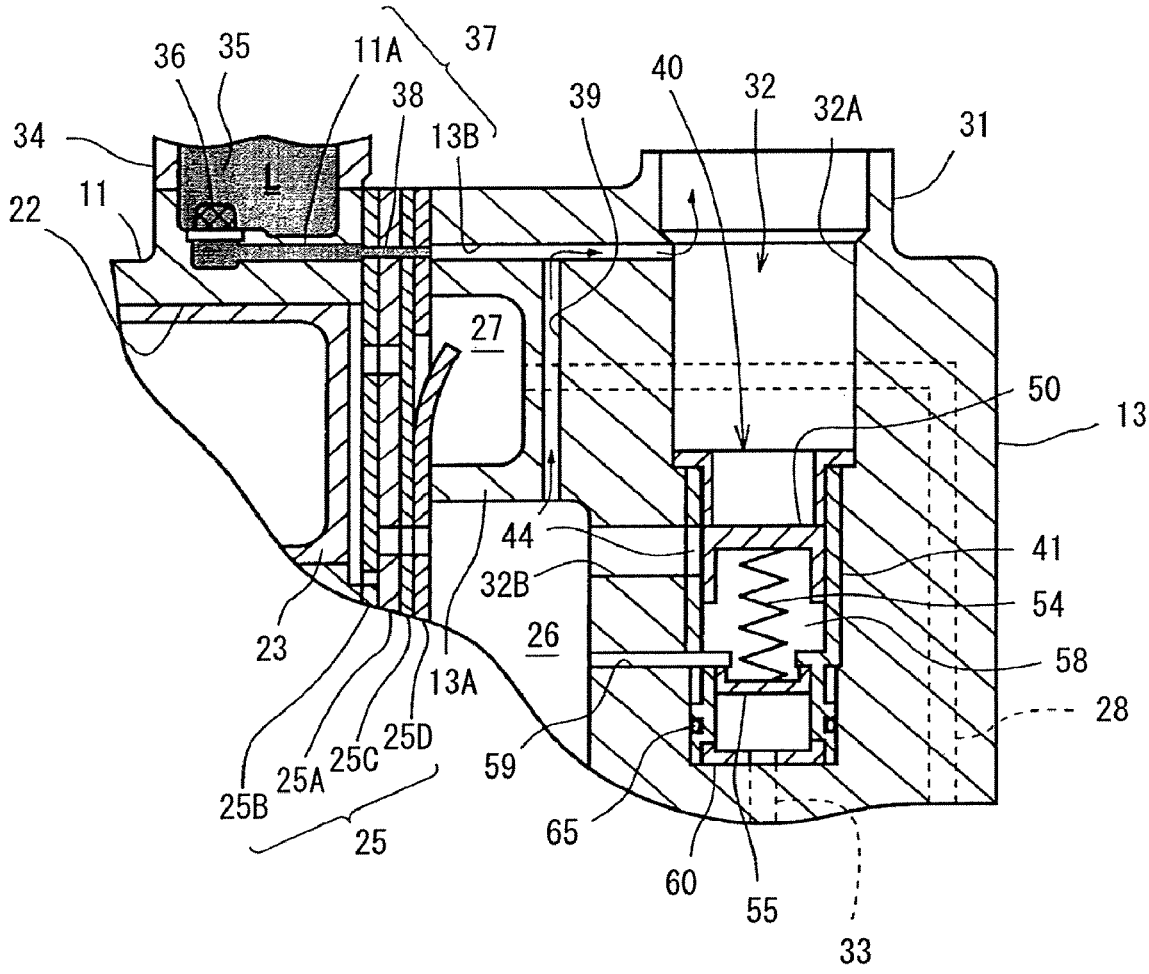
FIG. 3 is a fragmentary enlarged longitudinal cross-sectional view of the variable displacement compressor of FIG. 1 with the displacement control valve opened.
Figure 4:
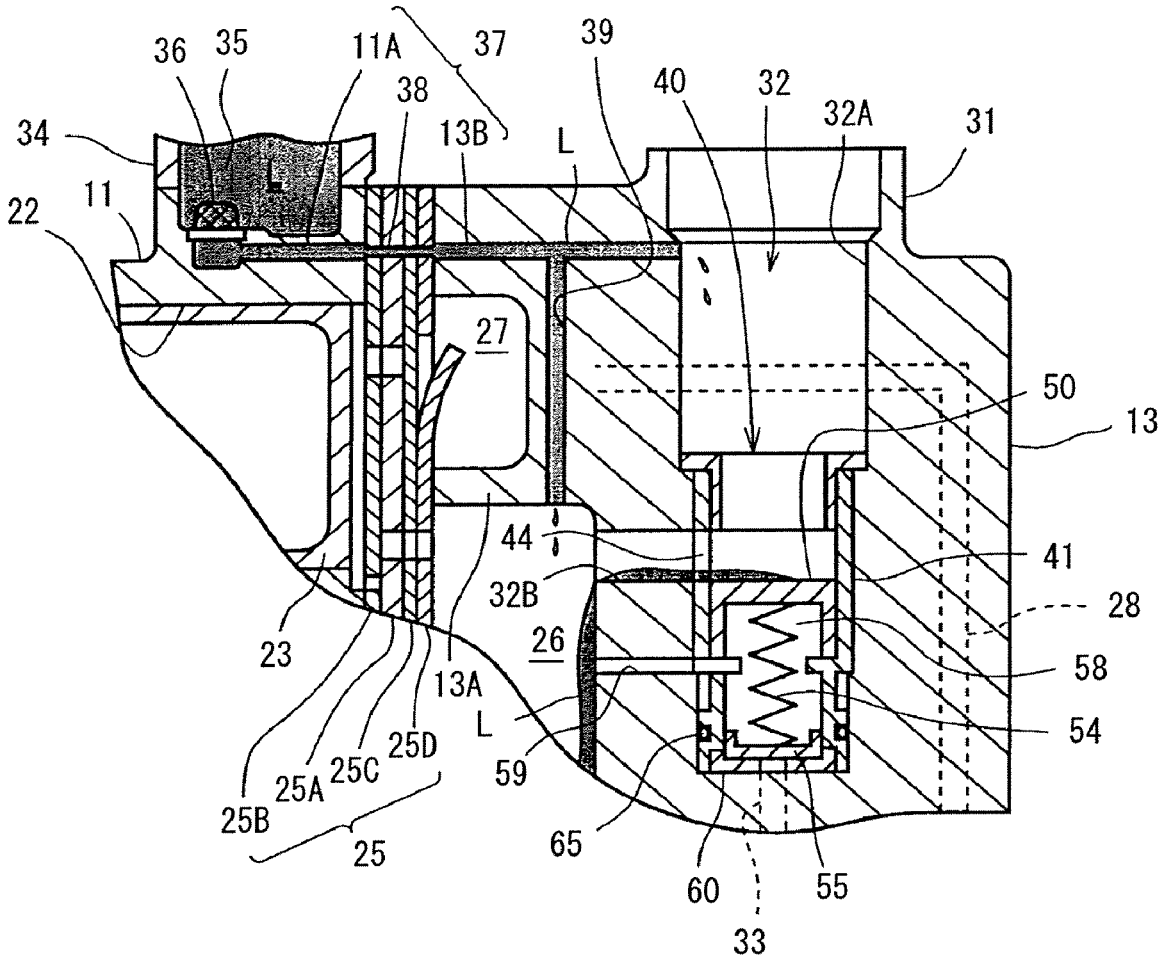
FIG. 4 is a fragmentary enlarged longitudinal cross-sectional view of the variable displacement compressor of FIG. 1 with the displacement control valve closed.

During the operation of the compressor, refrigerant gas flowing out from the discharge chamber 27 contains lubricating oil in the form of mist. The oil separator (not shown) in the compressor separates lubricating oil from the refrigerant gas under a discharge pressure. The lubricating oil separated in the oil separator is introduced into and stored in the oil reservoir 35 as shown in FIGS. 3, 4. Lubricating oil is indicated by reference symbol "L" in FIGS. 3, 4. A part of the lubricating oil L stored in the oil reservoir 35 is introduced through the lubricating oil passage 37 and the communication passage 39 into the suction chamber 26, while the rest of the lubricating oil is introduced through the lubricating oil passage 37 into the upstream suction passage 32A.

The displacement of the compressor is determined by the inclination angle of the swash plate 17 in accordance with the opening degree of the displacement control valve 29. The suction throttle valve 40 is operated in accordance with the opening and closing movement of the displacement control valve 29. In the process of compressor operation from the closed state to the opened state of the displacement control valve 29, refrigerant gas under a discharge pressure is introduced into the crank chamber 14 through the communication passage 28. As a result, the crank pressure Pc relative to the suction chamber 26 is increased, and the inclination angle of the swash plate 17 is gradually decreased, accordingly, and the operation of the compressor is rendered to be in minimum displacement. During the above process from the closed state to the opened state of the displacement control valve 29, the suction throttle valve 40 is operated as follows. The second valve body 55 is moved toward the uppermost position while urging the first valve body 50 through the coil spring 54 in such direction that the first valve body 50 closes the communication hole 44. The crank pressure Pc is increased relative to the pressure in the suction chamber 26. This causes refrigerant gas in the crank chamber 14 to flow through the bleed passage 30 into the suction chamber 26, and then through the communication passage 39 and the lubricating oil passage 37 into the upstream suction passage 32A. If the compressor continues to be operated at the minimum displacement, the pressure differential between the crank chamber 14 and the suction chamber 26 becomes substantially zero. In other words, the pressure in the crank chamber 14 becomes substantially same as the pressure in the suction chamber 26.

Referring to FIG. 3, the compressor is operating at the minimum displacement or at an initial stage of stop with the communication hole 44 closed by the first valve body 50. At this time, the pressure in the lubricating oil passage 37 downstream of the throttle passage 38 is lower than the increased crank pressure Pc. This is because the throttle passage 38 is provided in the lubricating oil passage 37. Therefore, the pressure in the lubricating oil passage 37 downstream of the throttle passage 38 is sufficiently decreased and lower than the internal pressure of the oil reservoir 35 upstream of the throttle passage 38. The part of the lubricating oil passage 37 to which the communication passage 39 is connected is positioned downstream of the throttle passage 38. The pressure in this part of the lubricating oil passage 37 is sufficiently lower than the internal pressure of the oil reservoir 35, and the increased pressure in the communication passage 39 is higher than the above pressure in the lubricating oil passage 37. Thus, refrigerant gas under an increased pressure in the crank chamber 14 is introduced into the suction chamber 26 through the bleed passage 30. Then, the refrigerant gas is introduced into the upstream suction passage 32A through the communication passage 39 and the lubricating oil passage 37. At this time, the refrigerant gas from the communication passage 39 blocks lubricating oil supplied from the oil reservoir 35. Therefore, when the compressor is changed to a large displacement operation in a short time after the compressor has been rendered to the minimum displacement or to a stop, the crank pressure Pc is decreased rapidly. Thus, the compressor may be restored to the maximum displacement operation smoothly.

When the compressor continues the minimum displacement operational state or to the stopped state, the crank pressure Pc becomes substantially the same as the pressure in the upstream suction passage 32A. At this time, lubricating oil in the oil reservoir 35 flows through the lubricating oil passage 37 again. A part of the lubricating oil in the oil reservoir 35 is supplied into the crank chamber 14 through the communication passage 39, while the rest of the lubricating oil is introduced into the upstream suction passage 32A upstream of the first valve body 50 to be stored. Thus, when the refrigerant gas in the crank chamber 14 flows through the lubricating oil passage 37 so as to decrease the crank pressure Pc, most of the lubricating oil L in the oil reservoir 35 remains in the oil reservoir 35. When the crank pressure Pc becomes substantially the same as the pressure in the upstream suction passage 32A, a part of the lubricating oil remains upstream of the first valve body 50. Thus, excessive flow of lubricating oil L into the suction chamber 26 hardly occurs. As a result, excessive storage of lubricating oil L in the crank chamber 14 hardly occurs.

During the process of compressor operation from the opened state of the displacement control valve 29 to the closed state thereof, the crank pressure Pc is decreased substantially to a suction pressure, which is a pressure in the suction-pressure region, and the inclination angle of the swash plate 17 is gradually increased toward the maximum. Accordingly, the compressor is operated at the maximum displacement. During this operation process, the second valve body 55 is moved from the uppermost position to the lowermost position, so that the urging force of the coil spring 54 acting on the first valve body 50 becomes substantially inactive. When the suction passage 32 is closed by the first valve body 50 during the compressor operation at the maximum displacement, refrigerant gas in the suction chamber 26 is drawn into the cylinder bore 22 at a flow rate corresponding to the maximum displacement operation. As a result, the pressure differential between the suction passage 32 and the damper chamber 58 across the first valve body 50 is increased. Accordingly, the first valve body 50 is moved downward thereby to open the suction passage 32.

With the communication hole 44 opened by the first valve body 50, a part of the lubricating oil in the lubricating oil passage 37 is introduced into the suction chamber 26 through the communication passage 39. Meanwhile, the rest of the lubricating oil is introduced into the upstream suction passage 32A. Referring to FIG. 4, the lubricating oil L introduced into the upstream suction passage 32A through the lubricating oil passage 37 then flows from the upstream side of the first valve body 50 through the communication hole 44. Thus, most of the lubricating oil L introduced into the lubricating oil passage 37 from the oil reservoir 35 is separated into two flows, one through the communication passage 39 and the other through the suction passage 32. However, the two flows of refrigerant gas meet together in the suction chamber 26 and finally drawn into the crank chamber 14.

The compressor may rapidly change the operation, for example, from a large displacement (or the maximum displacement) to the minimum displacement or to a stop, and then changed again to an increasing displacement (or the maximum displacement) in a short time.

According to the compressor of the first preferred embodiment, the following advantageous effects are obtained.

(1) When the operation of the compressor is changed from the maximum displacement to the minimum displacement or to a stopped state, the refrigerant gas under an increased pressure in the crank chamber 14 is introduced into the lubricating oil passage 37 through the communication passage 39. Refrigerant gas from the communication passage 39 blocks lubricating oil supplied from the oil reservoir 35, and then flows through the lubricating oil passage 37 into the upstream suction passage 32A of the suction throttle valve 40. According to this structure, when the compressor is changed to a large displacement operation in a short time after the compressor has been rendered to the minimum displacement or to a stop, the crank chamber pressure is decreased rapidly. Thus, the operation of the compressor returns to the maximum displacement smoothly.

(2) The compressor continues to be operated at the minimum displacement or at a stop after the compressor is changed to the minimum displacement operation or to a stop. Then, the internal pressure in the communication passage 39 becomes substantially the same as the pressure in the lubricating oil passage 37 downstream of the throttle passage 38. At this time, lubricating oil in the oil reservoir 35 flows through the lubricating oil passage 37 again. Part of the lubricating oil is supplied into the crank chamber 14 through the communication passage 39, while the rest of the lubricating oil is stored in the upstream suction passage 32A to be stored. This prevents the lubricating oil to be supplied excessively into the crank chamber 14.

(3) After the compressor is stopped, lubricating oil is stored in the upstream suction passage 32A upstream of the suction throttle valve 40, so that excessive storage of lubricating oil in the crank chamber 14 will hardly occur. Thus, agitation of lubricating oil by rotating parts of the compressor such as a swash plate 17 and compression of lubricating oil during restarting of the compressor are prevented. As a result, reduction in durability and in operating performance of the compressor due to an increased temperature of lubricating oil may be prevented.

(4) Lubricating oil separated from refrigerant gas is returned into the suction passage 32 through the lubricating oil passage 37. This helps to decrease the temperature of the lubricating oil, thereby improving the durability of the compressor.

(5) Supplying lubricating oil to the upstream suction passage 32A upstream of the suction throttle valve 40, lubricating oil flows into the clearance between the first valve body 50 and the inner surface of the valve housing 41, thus providing an oil seal in the suction throttle valve 40. The suction throttle valve 40 is operated in accordance with the pressure differential between the crank pressure and the suction pressure. Therefore, the provision of such oil seal helps to improve the controlling operation of the suction throttle valve 40 by reducing leakage of refrigerant gas between the crank chamber 14 and the suction chamber 26.

(6) In the case of a compressor of variable displacement type, if an excessive amount of lubricating oil is stored in the crank chamber, temperature of lubricating oil is increased due to shearing heat. Additionally, the swash plate receives resistance from the lubricating oil when the operation of the compressor returns to the maximum displacement operation. This delays the returning of the swash plate to the position of the maximum inclination angle. According to the embodiment of the present invention, an excessive amount of lubricating oil is prevented from being stored in the crank chamber 14 and therefore, the delayed movement of the swash plate to the position of the maximum inclination angle is prevented.

(7) According to the embodiment of the present invention, with the suction throttle valve 40 is closed, the lubricating oil in the oil reservoir 35 may be introduced through the lubricating oil passage 37, the communication passage 39, and the suction chamber 26 into the crank chamber 14. In comparison with a compressor having no passage similar to the communication passage 39, an adequate amount of lubricating oil may be supplied to the crank chamber 14. Therefore, lubrication may be provided successively on various sliding parts in the crank chamber 14 of the compressor of the first preferred embodiment.

(8) Lubricating oil in the oil reservoir 35 may be introduced into the suction chamber 26 through the lubricating oil passage 37 and the communication passage 39. Refrigerant gas in the suction chamber 26 has a temperature which is lower than that of refrigerant gas under a discharge pressure. Lubricating oil in the oil reservoir 35 separated from refrigerant gas under a discharge pressure has a temperature which is higher than that of the refrigerant gas under a suction pressure. Lubricating oil introduced into the suction chamber 26 is cooled down by refrigerant gas under the suction pressure thereby to prevent the temperature of the compressor from increasing. If the suction chamber 26 has a sufficient volume as compared to the suction passage 32 and the bleed passage 30, lubricating oil may be easily cooled as compared to the case in which the communication passage 39 is connected with the suction passage 32 and the bleed passage 30.

The following will describe a compressor according to the second preferred embodiment with reference to FIGS. 5 through 8. The compressor of the second preferred embodiment differs from that of the first preferred embodiment in that a throttle mechanism is provided in a lubricating oil passage. For the sake of convenience of description, like or same parts or elements will be indicated by the same reference numeral as those which have been used in the first embodiment and the description thereof will be omitted.

Figure 5:
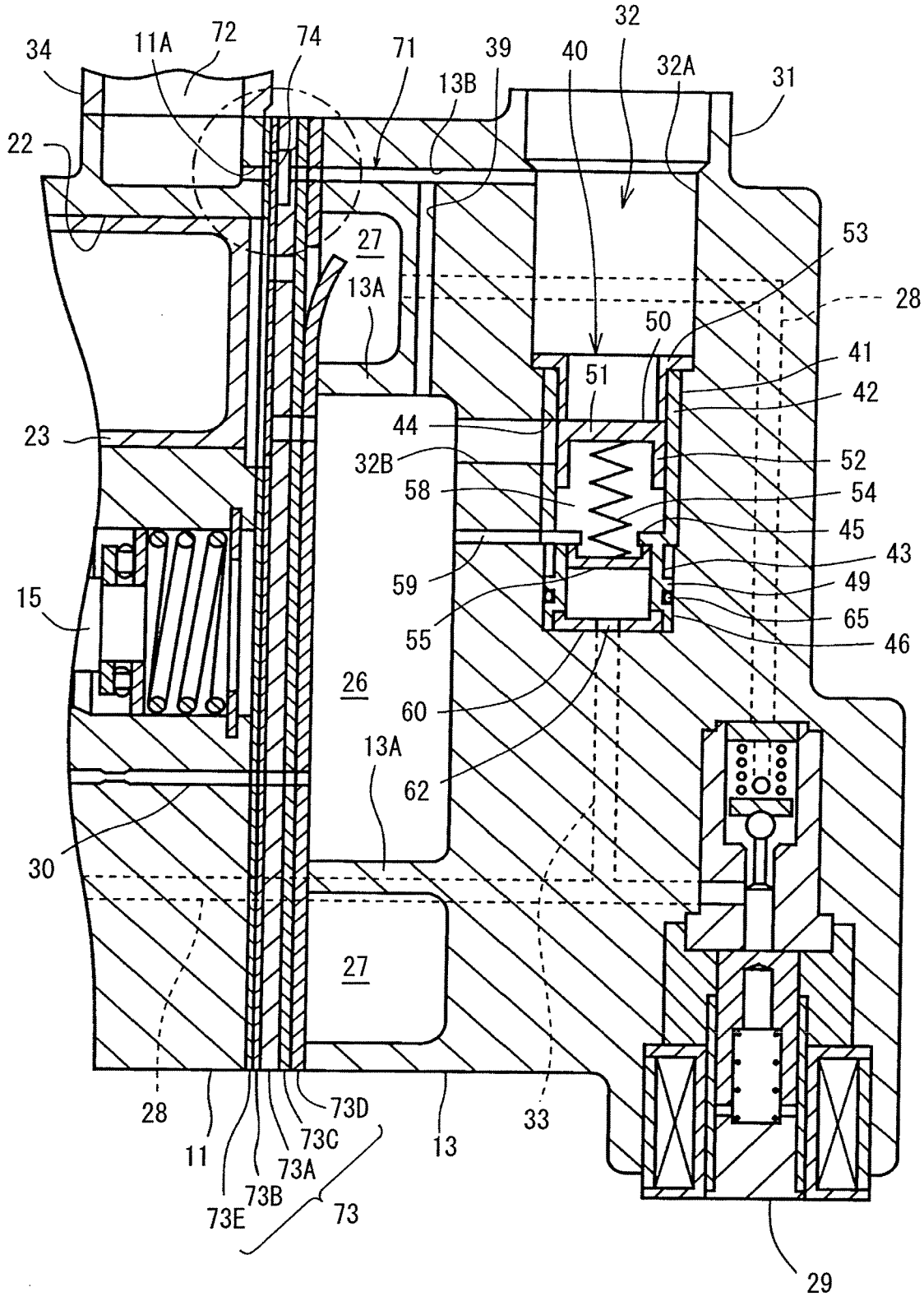
FIG. 5 is a fragmentary enlarged longitudinal cross-sectional view of a variable displacement compressor according to a second preferred embodiment of the present invention.

Referring to FIG. 5, a lubricating oil passage 71 which is similar to the lubricating oil passage 37 in the first preferred embodiment is formed between the upstream suction passage 32A and an oil reservoir 72 in the cylinder block 11. The lubricating oil passage 71 has the cylinder block passage 11A, the rear housing passage 13B and holes A, C, D and E. The cylinder block passage 11A is formed in the cylinder block 11 and in communication with the oil reservoir 72 at the bottom of the cylinder block passage 11A. The rear housing passage 13B is formed in the rear housing 13 and in communication with the suction passage 32 upstream of the suction throttle valve 40. The holes A, C, D and E are formed in a valve forming assembly 73. According to the second preferred embodiment, the cylinder block passage 11A is in communication with the oil reservoir 72 through no filter. The valve forming assembly 73 has a valve plate 73A, a suction valve forming plate 73B, a discharge valve forming plate 73C, a retainer forming plate 73D and a gasket 73E. The gasket 73E is interposed between the cylinder block 11 and the suction valve forming plate 73B.

Figure 6:
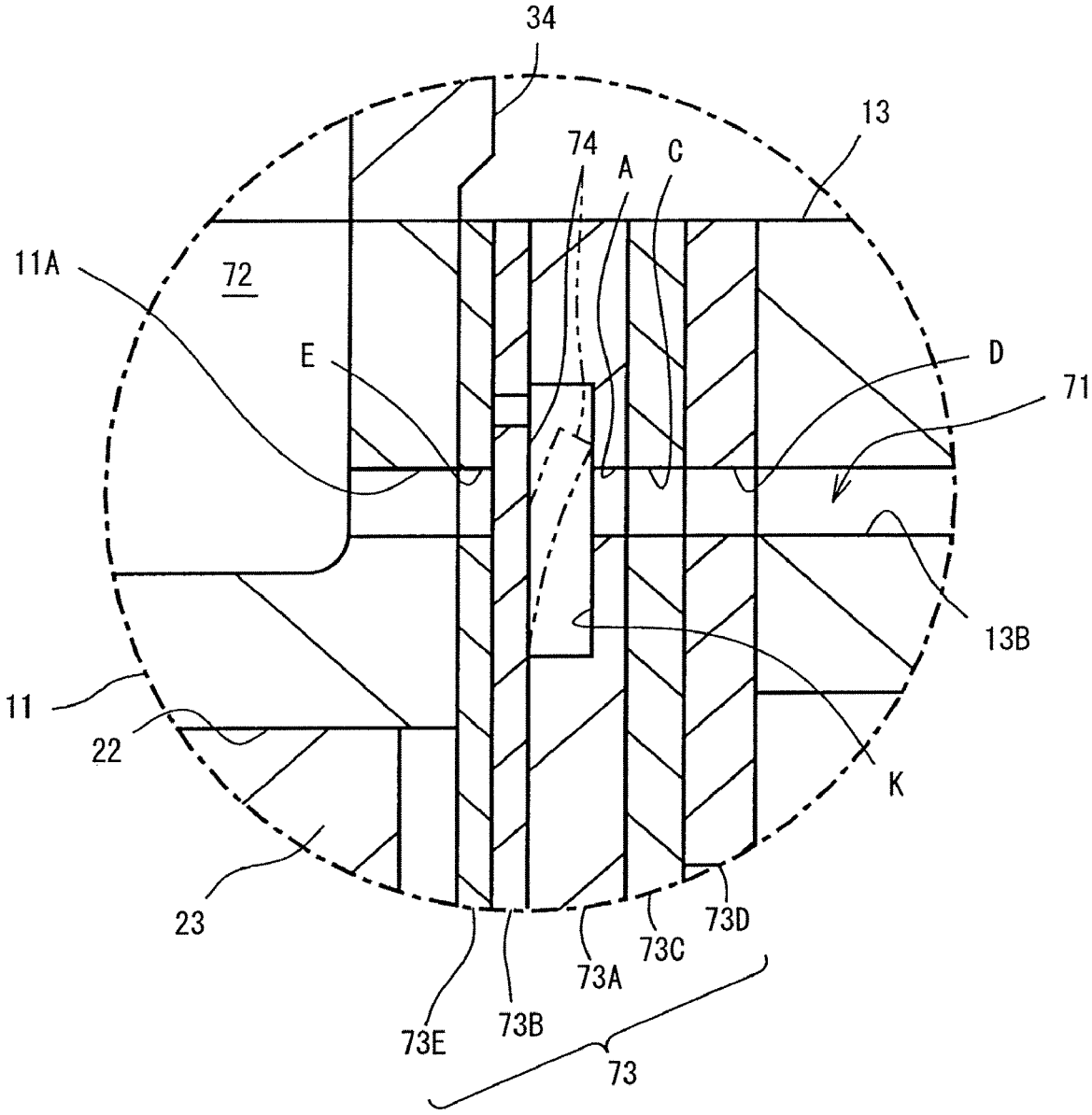
FIG. 6 is a partially enlarged longitudinal cross-sectional view of a lubricating oil passage of the variable displacement compressor of FIG. 5.
Figure 7:
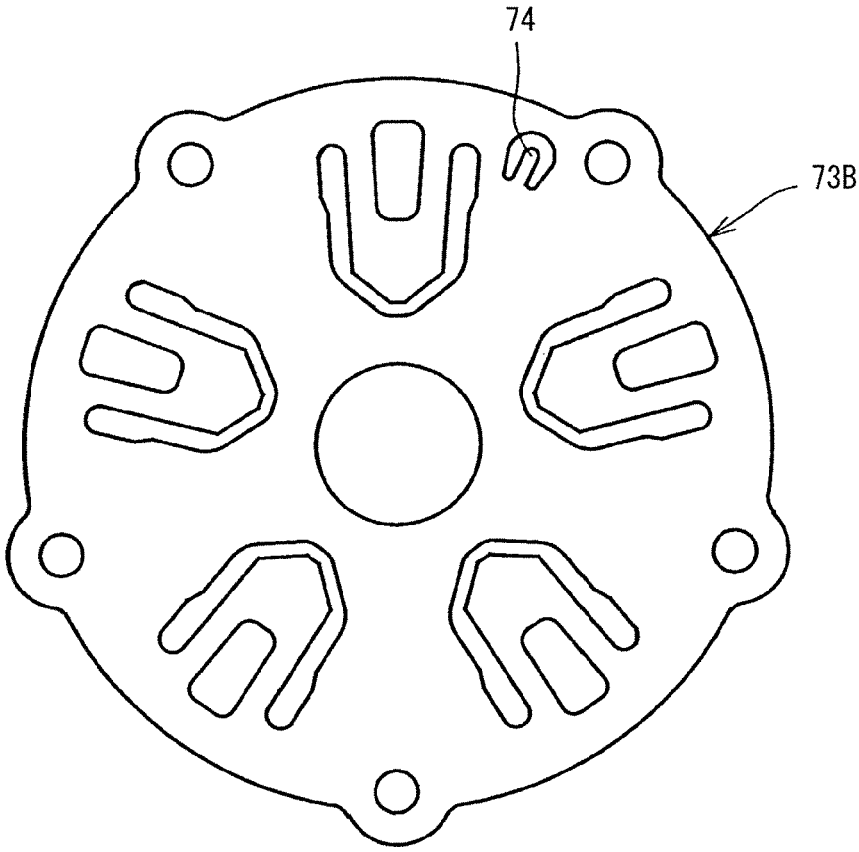
FIG. 7 is a front view of a suction valve forming plate having a reed valve in the variable displacement compressor of FIG. 6.

Referring to FIG. 6, the holes A, C, D and E are formed through the valve forming assembly 73. The hole A is formed through the valve plate 73A. The hole C is formed through the discharge valve forming plate 73C. The hole D is formed through the retainer forming plate 73D. The hole E is formed through the gasket 73E. Each of the holes A, C, D and E has the same diameter as the cylinder block passage 11A and the rear housing passage 13B. The suction valve forming plate 73B has a flexible reed valve 74 as an opening and closing valve serving as a throttle mechanism as shown in FIGS. 6, 7. The reed valve 74 in the non-flexed position indicated by solid line in FIG. 6 substantially closes the hole E of the gasket 73E. However, the reed valve 74 is so configured that a slight amount of lubricating oil is allowed to flow through the hole E when the reed valve 74 is in non-flexed position.

The valve plate 73A has a cutout K formed therein for providing a space for the flexed reed valve 74. The reed valve 74 is also so configured that the hole A of the valve plate 73A is substantially closed by the reed valve 74 flexed to the maximum degree relative to the hole E, as indicated by chain double-dashed line in FIG. 6. In this state, a slight amount of lubricating oil is allowed to flow through the hole A. The reed valve 74 is flexed or bent in accordance with the pressure differential between the pressure in the oil reservoir 72 and the pressure in the upstream suction passage 32A. In the second preferred embodiment, the reed valve 74 in non-flexed position substantially closes the hole E of the gasket 73E. The hole E of the gasket 73E serves as a first valve hole in the lubricating oil passage 71. The hole A of the valve plate 73A is a second valve hole of the lubricating oil passage 71.

Figure 8:
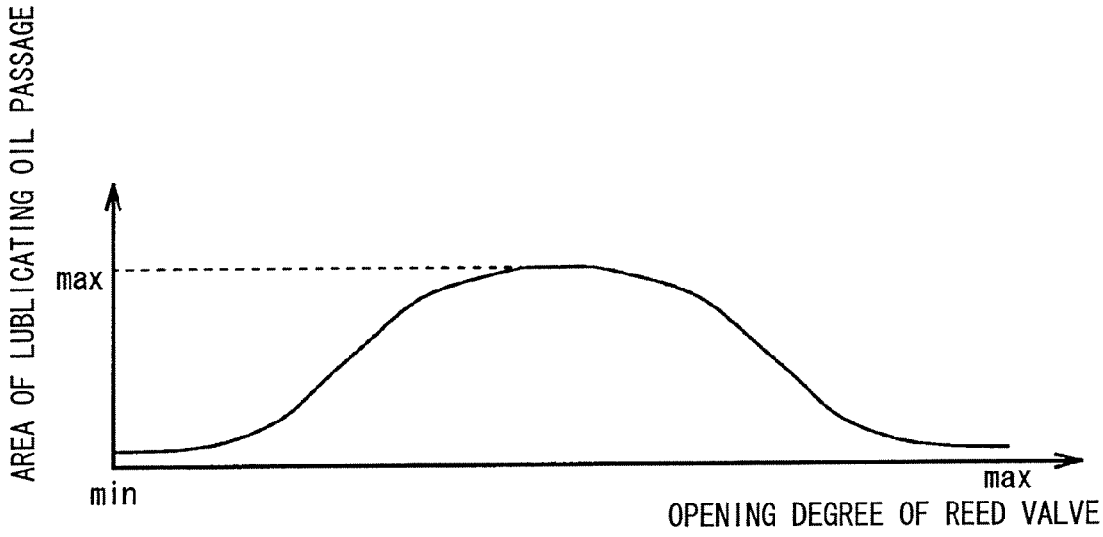
FIG. 8 is a graph showing relation between the opening degree of the reed valve with respect to the hole E and the area of the lubricating oil passage.

According to the second preferred embodiment, when the pressure differential between the oil reservoir 72 and the upstream suction passage 32A is small, the reed valve 74 is in the non-flexed position and, therefore, the hole E is substantially closed. With the hole E thus closed, the flow rate of the lubricating oil through the lubricating oil passage 71 is restricted. As the pressure differential between the oil reservoir 72 and the upstream suction passage 32A is increased, the reed valve 74 is bent to open the hole E, thereby increasing the flow rate of lubricating oil. When the pressure differential is further increased, the reed valve 74 is bent to the maximum extent, thereby substantially closing the hole A as the second valve hole. Therefore, the flow rate of the lubricating oil through the lubricating oil passage 71 is restricted. When the operation of the compressor is changed from the maximum displacement to the minimum displacement thereof or to a stopped state, the lubricating oil passage 71 downstream of the reed valve 74 is placed under a high pressure. This is because refrigerant gas under a high pressure in the communication passage 39 is introduced into the lubricating oil passage 71. Thus, the pressure differential between the oil reservoir 72 and the lubricating oil passage 71 downstream of the reed valve 74 is decreased. Therefore, the reed valve 74 moves so as to close the hole A thereby to reduce the amount of the lubricating oil supplied from the oil reservoir 72. The reed valve 74 may block the flowing of lubricating oil through the hole E reliably. Therefore, the refrigerant gas under an increased pressure in the crank chamber 14 may be released through the communication passage 39 and the lubricating oil passage 71 to the upstream suction passage 32A upstream of the suction throttle valve 40. FIG. 8 is a graph showing relation between the opening degree of the reed valve with respect to the hole E and the area of the lubricating oil passage.

The reed valve 74 provided in the lubricating oil passage 71 regulates more effectively the flow of refrigerant gas from the oil reservoir 72 through the lubricating oil passage 71 into the suction passage 32 in comparison to the case wherein the throttle passage 38 is used. (This flow is called "gas pass phenomenon".) When the compressor is operating under a high load and a low rotational speed, the discharge pressure is high in spite of that the flow rate of refrigerant gas is low. Thus, the separation of lubricating oil from refrigerant gas is poor. However, the discharge pressure becomes high due to the high load and, then, the pressure differential between the oil reservoir 72 and the upstream suction passage 32A becomes increased, so that the flow rate of lubricating oil flowing through the lubricating oil passage 71 is increased. In this state, the reed valve 74 may substantially close the hole A thereby to restrict the flow rate of the lubricating oil and prevent the flow of refrigerant gas through the lubricating oil passage 71 into the suction passage 32 or prevent the aforementioned gas pass phenomenon. Furthermore, the provision of the reed valve 74 restricting the flow rate of lubricating oil by throttling dispenses with a passage having a reduced diameter to serve as a throttle mechanism in the lubricating oil passage 71. Therefore, there is no fear of the passage being clogged with foreign matters and no filter is required in the lubricating oil passage.

Figure 9:
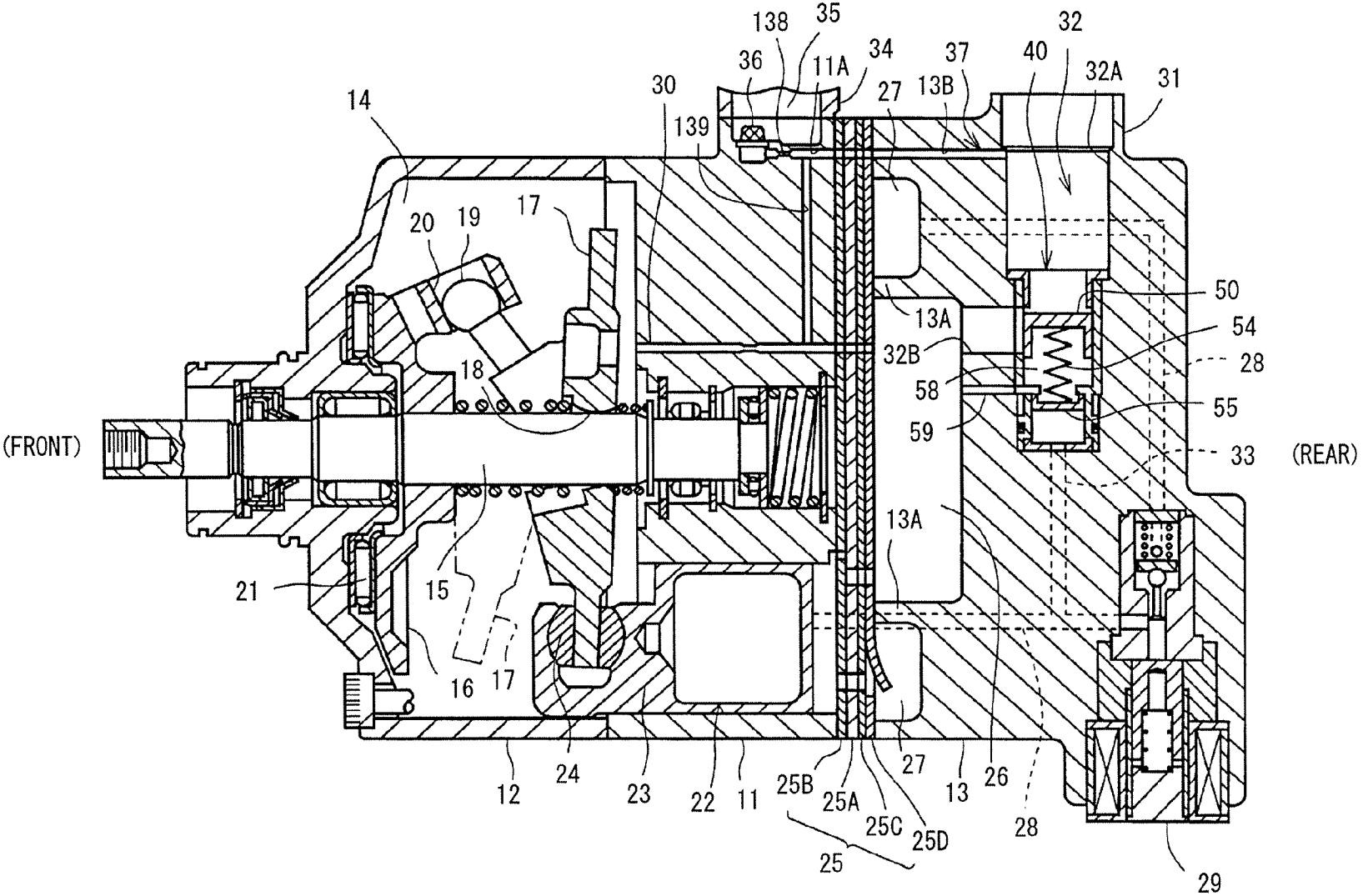
FIG. 9 is a longitudinal cross sectional view of a clutchless type variable displacement compressor according to a third preferred embodiment of the present invention.

The following will describe a compressor according to the third preferred embodiment of the present invention with reference to FIG. 9. The compressor of the third preferred embodiment is of a variable displacement type, whose displacement is varied in accordance with the inclination angle of the swash plate, as in the compressor according to the first and second preferred embodiments. The compressor shown in FIG. 9 has substantially the same structure as the compressor of the first preferred embodiment. Therefore, like or same parts or elements will be indicated by the same reference numeral as those which have been used in the first embodiment and the description thereof will be omitted.

The compressor of the third preferred embodiment has the lubricating oil passage 37 which connects the oil reservoir 35 to the upstream suction passage 32A. The lubricating oil passage 37 has the cylinder block passage 11A, the rear housing passage 13B and a throttle passage 138. The cylinder block passage 11A is formed in communication with the oil reservoir 35 at the bottom thereof in the cylinder block 11. The rear housing passage 13B is formed in communication with the suction passage 32 on the upstream side of the suction throttle valve 40 in the rear housing 13. The throttle passage 138 is formed to serve as a throttle mechanism in the cylinder block passage 11A. The lubricating oil passage 37 is a passage through which lubricating oil in the oil reservoir 35 is supplied to the suction passage 32 (or the upstream suction passage 32A) upstream of the suction throttle valve 40. The throttle passage 138 in the cylinder block passage 11A is formed with a diameter which is smaller than those of the cylinder block passage 11A and the rear housing passage 13B. According to the third preferred embodiment, a communication passage 139 is provided on the downstream side of the throttle passage 138 in communication with the bleed passage 30 as a gas flow passage. Specifically, the communication passage 139 connects the bleed passage 30 to the lubricating oil passage 37.

According to the third preferred embodiment, the communication passage 139 is provided for connecting the bleed passage 30 to the lubricating oil passage 37. Thus, refrigerant gas in the crank chamber 14 flows easily through the bleed passage 30 and the communication passage 139 to the upstream suction passage 32A even when the suction passage 32 is closed by the suction throttle valve 40. When the operation of the compressor is changed from the maximum displacement to the minimum displacement or to a stopped state, refrigerant gas of an increased pressure in the crank chamber 14 is introduced into the lubricating oil passage 37 through the communication passage 139. Refrigerant gas thus introduced from the communication passage 139 blocks the flow of lubricating oil from the oil reservoir 35, and then flows out to the upstream suction passage 32A of the suction throttle valve 40 through the lubricating oil passage 37. When the operation of the compressor is changed back to the maximum displacement in a short time after being changed to the minimum displacement or to a stop, the crank pressure Pc is decreased rapidly. Thus, the operation of the compressor restores the maximum displacement smoothly. During compressor operation under a large displacement, lubricating oil may be supplied into the crank chamber 14 through the lubricating oil passage 37 and the communication passage 139. According to the third preferred embodiment, since the communication passage 139 is formed in the cylinder block 11, there is no need to form a communication passage in the rear housing 13 having a suction chamber 26 and a discharge chamber 27. Accordingly, the communication passage 139 may be formed in the rear housing 13 irrespective of the location of the suction chamber 26 and the discharge chamber 27.

Figure 10:
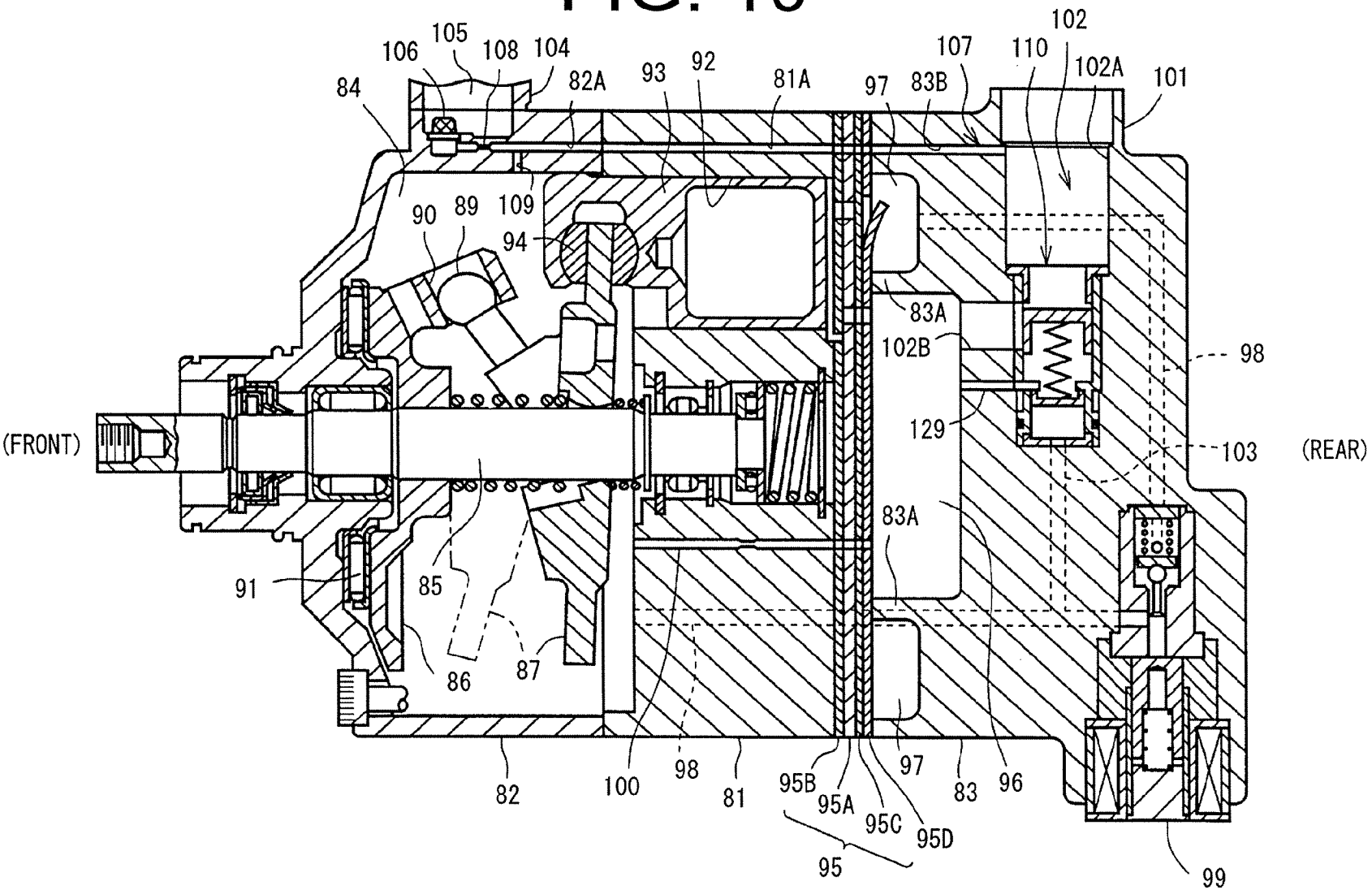
FIG. 10 is a longitudinal cross-sectional view of a clutchless type variable displacement compressor according to a fourth preferred embodiment of the present invention.

The following will describe a compressor according to the fourth preferred embodiment of the present invention with reference to FIG. 10. The compressor of the fourth preferred embodiment is of a variable displacement type, whose displacement is varied in accordance with the inclination angle of the swash plate, as in the compressor of the first through third preferred embodiments. Referring to FIG. 10, the compressor has a cylinder block 81, a front housing 82 and a rear housing 83. The cylinder block 81 has a plurality of cylinder bores 92 formed therethrough. The cylinder block 81 is joined to the front housing 82 at the front end thereof, and to the rear housing 83 at the rear end thereof. Between the rear housing 83 and the cylinder block 81 is interposed a valve plate 95A, a suction valve forming plate 95B, a discharge valve forming plate 95C and a retainer forming plate 95D which form a valve forming assembly 95.

The cylinder block 81 and the front housing 82 support a rotary shaft 85 rotatably. The cylinder block 81 has a plurality of cylinder bores 92. Each cylinder bore 92 accommodates a single-headed piston 93 therein for reciprocation. A crank chamber 84 is defined in the cylinder block 81 and the front housing 82. The crank chamber 84 accommodates a swash plate 87 therein rotatable integrally with the rotary shaft 85. The swash plate 87 is engaged at the outer peripheral portion thereof with pistons 93 through a pair of shoes 94 and slidable relative to the shoes 94.

In the rear housing 83, a suction chamber 96 is formed at a radially inner region of the rear housing 83, and a discharge chamber 97 is formed at a radially outer region so as to surround the suction chamber 96. The rear housing 83 has a suction passage 102 and a suction throttle valve 110. The suction passage 102 has an upstream suction passage 102A on the upstream side of the suction throttle valve 110 and a downstream suction passage 102B on the downstream side of the suction throttle valve 110. The suction passage 102 is formed in communication with the suction chamber 96, and the suction throttle valve 110 is formed in the suction passage 102. The structure of the suction throttle valve 110 is substantially the same as the suction throttle valve 40 of the first and second preferred embodiments. The suction throttle valve 110 has a valve body 120 which is operable in accordance with a pressure differential between the suction chamber 96 and the upstream suction passage 102A located on the upstream side of the suction throttle valve 110. The downstream suction passage 102B is formed in communication with the suction chamber 96. According to the fourth preferred embodiment, the front housing 82 has an oil reservoir 105 at the outer peripheral surface thereof for storing therein lubricating oil separated from refrigerant gas under a discharge pressure by an oil separator (not shown).

A lubricating oil passage 107 is formed for connecting the oil reservoir 105 to the upstream suction passage 102A. The lubricating oil passage 107 has a front housing passage 82A, a cylinder block passage 81A, a rear housing passage 83B and a throttle passage 108. The front housing passage 82A is formed in the front housing 82 so as to communicate with the oil reservoir 105 at the bottom thereof. The cylinder block passage 81A is formed in communication with the front housing passage 82A in the cylinder block 81. The rear housing passage 83B is formed in the rear housing 83 so as to communicate with the upstream suction passage 102A upstream of the suction throttle valve 110. The throttle passage 108 is formed to serve as a throttle mechanism in the front housing passage 82A. The lubricating oil passage 107 is a passage through which lubricating oil stored in the oil reservoir 105 is supplied into the suction passage 102 (or the upstream suction passage 102A) on the upstream side of the suction throttle valve 110.

According to the fourth preferred embodiment, the throttle passage 108 is formed in the front housing passage 82A with a diameter which is smaller than those of the cylinder block passage 81A, the front housing passage 82A and the rear housing passage 83B. The front housing 82 has a communication passage 109. The communication passage 109 is connected to the front housing passage 82A downstream of the throttle passage 108, and in communication with the crank chamber 84. In other words, the communication passage 109 connects the crank chamber 84 to the lubricating oil passage 107. Descriptions of the elements shown in FIG. 10 will be omitted because the elements correspond to the counterparts of the first preferred embodiment. The elements are a partition 83A, a rotary shaft 85, a lug plate 86, a guide pin 89, a guide hole 90, a thrust bearing 91, a communication passage 98, a displacement control valve 99, a bleed passage 100, an inlet 101, a branch passage 103, a flange 104, a filter 106 and a damper communication passage 129.

According to the fourth preferred embodiment, the communication passage 109 is provided so as to connect the crank chamber 84 to the lubricating oil passage 107. This makes it easy for refrigerant gas in the crank chamber 84 to flow through the communication passage 109 to the upstream suction passage 102A even when the suction passage 102 is closed by the suction throttle valve 110. When the operation of the compressor is changed to the maximum displacement to the minimum displacement thereof or to a stopped state, refrigerant gas under an increasing pressure in the crank chamber 84 is introduced into the lubricating oil passage 107 through the communication passage 109. The refrigerant gas introduced from the communication passage 109 blocks lubricating oil supplied from the oil reservoir 105, and then the refrigerant gas flows out through the lubricating oil passage 107 to the upstream suction passage 102A upstream of the suction throttle valve 110. Therefore, when the operation of the compressor is changed to a large displacement in a short time after being changed to the minimum displacement thereof or to a stop, the crank pressure Pc may be reduced rapidly. Thus, the operation of the compressor may be returned smoothly to the maximum displacement. During the compressor operation under the maximum displacement, lubricating oil may be introduced into the crank chamber 84 through the lubricating oil passage 107 and the communication passage 109. According to the fourth preferred embodiment, the communication passage 109 is formed in communication with the crank chamber 84. The distance from the oil reservoir 105 to the upstream suction passage 102A becomes larger and, therefore, the lubricating oil passage 107 becomes longer than those of the first through third preferred embodiments. However, the communication passage 109 can be made much shorter than the counterpart passages of the first through third preferred embodiments.

The present invention is not limited to the above-described first through fourth preferred embodiments, but it may be practiced in various other ways as exemplified below. In the first through fourth preferred embodiments, the suction throttle valve has valve bodies connected to each other through a coil spring. Alternatively, the valve bodies may be connected to each other through any other suitable connecting member in place of the coil spring. The suction throttle valve may of any type as long as the valve bodies thereof are movable according to the pressure differential between the pressure in the crank chamber and the suction pressure.

In the first through fourth preferred embodiments, the suction throttle valve is operable to adjust the opening degree of the suction passage based on the pressure differential between the pressure in the crank chamber and the suction pressure. Alternatively, a suction throttle valve may be used which is operable to adjust the opening degree of the suction passage based on the pressure differential between the upstream suction passage and the suction chamber.

In the second preferred embodiment, it is so arranged that when the reed valve 74 closes the hole E of the gasket 73E of the first valve hole, a slight amount of lubricating oil is allows to flow from the hole E through the reed valve 74. Alternatively, the reed valve 74 when closing the hole E may completely is block the flow of lubricating oil therethrough. In the second preferred embodiment, the reed valve 74 is provided in the suction valve forming plate 73B. Alternatively, a reed valve may be disposed in the discharge valve forming plate 73C. The cutout K is formed with a substantially U-shaped cross section in the valve plate 73A. The shape of cross section of the cutout K may be changed according to the desired opening degree of the reed valve 74.

Therefore, the present examples and embodiments are to be considered as illustrative and not restrictive, and the invention is not to be limited to the details given herein but may be modified within the scope of the appended claims.

What is claimed is:

1. A variable displacement compressor comprising:

a housing defining a crank chamber;

a rotary shaft rotatably supported by the housing;

a swash plate accommodated in the crank chamber, tiltably supported by the rotary shaft and rotating integrally with the rotary shaft;

a suction-pressure region including a suction chamber and a suction passage through which refrigerant gas under a pressure lower than a discharge pressure passes to the suction chamber;

a suction throttle valve having a valve body for adjusting the opening of the suction passage, the suction throttle valve arranged in the suction passage and defining an upstream suction-pressure region located upstream of the suction throttle valve and a downstream suction-pressure region located downstream of the suction throttle valve in the suction-pressure region;

an oil reservoir storing lubricating oil separated from refrigerant gas;

a lubricating oil passage connecting the oil reservoir to the upstream suction-pressure region;

a gas flow passage connecting the crank chamber to the suction chamber;

a communication passage connecting the lubricating oil passage to at least one of the downstream suction-pressure region, the gas flow passage and the crank chamber; and a throttle mechanism provided in the lubricating oil passage between the oil reservoir and a position where the communication passage connects to the lubricating oil passage.

2. The variable displacement compressor according to claim 1, wherein the valve body adjusts the opening of the suction passage in accordance with a pressure differential acting on the valve body wherein the valve body has a first side opposite to a second side, the pressure differential is a difference between a suction pressure and a crank pressure, and the pressure differential is applied to the first and second sides of the valve body.

3. The variable displacement compressor according to claim 2, wherein the valve body has a pair of the valve bodies connected to each other by a coil spring.

4. The variable displacement compressor according to claim 1, wherein the communication passage connects the suction chamber in the downstream suction-pressure region to the lubricating oil passage.

5. The variable displacement compressor according to claim 1, wherein the throttle mechanism has a throttle passage included in the lubricating oil passage and formed with a smaller cross-section than any cross-section of any other part of the lubricating oil passage.

6. The variable displacement compressor according to claim 1, wherein the throttle mechanism has a reed valve serving as an opening and closing valve for opening and closing the lubricating oil passage in accordance with a pressure differential between a pressure in the oil reservoir and a pressure in the upstream suction-pressure region.

7. The variable displacement compressor according to claim 6, wherein the reed valve has a first valve hole and a second valve hole, which are formed on the opposite sides of the reed valve, wherein the reed valve moves between the first valve hole and the second valve hole so as to close either the first or the second valve hole.

* * * * *